United States Patent [19]

Voelz

[11] 4,305,513

[45] Dec. 15, 1981

[54] SLACK CABLE SENSING APPARATUS

[75] Inventor: Richard F. Voelz, Butler, Wis.

[73] Assignee: Renner Manufacturing, Milwaukee, Wis.

[21] Appl. No.: 81,874

[22] Filed: Oct. 4, 1979

[51] Int. Cl.[3] ..... B66C 13/10; B66D 1/54

[52] U.S. Cl. ..... 212/217; 212/220; 254/273

[58] Field of Search ..... 254/273, 272, 270; 212/217, 218, 220; 242/37 R, 49, 57, 75.5; 104/178, 179, 183

[56] References Cited

U.S. PATENT DOCUMENTS

| | | | |
|---|---|---|---|
| 1,848,972 | 3/1932 | Peebles | 254/273 |
| 1,990,241 | 2/1935 | Mizer | 254/273 |
| 2,720,093 | 10/1955 | Lambach et al. | 242/75.5 X |
| 3,329,284 | 7/1967 | Bogart et al. | 212/217 |
| 3,780,989 | 12/1973 | Peterson | 254/273 |
| 3,805,967 | 4/1974 | Scannell | 212/217 |

*Primary Examiner*—John M. Jillions
*Attorney, Agent, or Firm*—Fred Wiviott

[57] ABSTRACT

An apparatus is described for detecting a slack cable condition on material handling carriers, hoisting equipment and the like. The device is mounted adjacent the winch drum and is designed for disabling the operation of the winch when the load comes to rest and the cable slackens. When a load is being supported by the cable and the cable is taut, an interface portion of the sensing apparatus is biased to a first position. However, when the load comes to rest and the cable slackens, a bias spring functions to position the interface portion of the sensor to a second position and to preclude further operation of the winch and prevent undesirable cable unwinding.

5 Claims, 5 Drawing Figures

SLACK CABLE SENSING APPARATUS

FIELD OF THE INVENTION

This invention relates generally to the art of cable winding and unwinding apparatus and in particular to apparatus for preventing unintentional unraveling of cables from winch drums.

BACKGROUND OF THE INVENTION

Winches, such as are used on material handling carriers, hoisting equipment, overhead cranes and the like, have been susceptible to undesirable cable unraveling from the winch drum after the load has come to rest if the winch drive motor is not promptly turned off by the machine operator. Normally the cable is wrapped around the winch drum in spiral grooves. If tension on the cable is relaxed and the drum motor continues to rotate in the unwinding direction, the wraps of cable can separate from their grooves and overlay upon themselves, resulting in cable wear and, often, improper function of the winch when the next load needs to be lifted. Further, such unwinding often results in the cable becoming entangled with other portions of the machine structure which can lead to cable breakage or injury to the operator. These problems are particularly serious when the carrier is equipped with multiple winches in that malfunction of one or more winches may result in the load being tipped or spilled.

Certain types of apparatus are known to the art for disabling a winch if a slack cable condition exists. One type employs a traveling-nut limit switch, which has a threaded shaft mechanically coupled to the rotating shaft of a winch drum so that the two shafts are colinear and rotate coincidently. A threaded nut is mounted on the limit switch and moves back and forth along the length of the shaft as the shaft rotates. Near one end of its path, the nut engages an interface device, usually an electrical contact set, which is thereby repositioned to de-activate the winch motor and preclude further unwinding of the cable. The position of the electrical contact set is adjustable with respect to the traveling nut to effect repositioning of the contacts by the traveling nut at the moment the load comes to rest and the cable starts to become slack.

There are several disadvantages to apparatus of this type, one being that it can not compensate for elongation or stretching of the cable which commonly occurs after extended use. Once the cable has stretched, a slack condition and cable unraveling can occur before the traveling nut activates the electrical contact set. Another disadvantage of such an apparatus is that, of necessity, it must be preset for a particular assumed load platform height. If the machine operator tries to deposit a load into, say, a pit below this assumed height, the traveling nut device causes premature shutoff of the winch. On the other hand, if the operator attempts to deposit the load above the assumed height, a slack cable condition and cable unraveling can occur well in advance of the shut-off point preset within the traveling nut apparatus.

Another sensing apparatus known to the art includes a loop or bale formed of rigid rod or wire surrounding the cable at a point above the hook block and just below the lifting carriage. This bale is attached to an interface device, usually an electrical contact set, by means of a rigid lever support member. Slackening of the cable causes a lateral displacement of the bale and movement of the lever support in a manner to reposition the interface device, precluding further operation of the winch in the unwinding direction. One disadvantage of this type of apparatus is that a slack cable condition adjacent the hook block may cause the winch to stop even though the cable at the winch drum itself has not become slack, e.g. as may be caused by friction in the reeving pulleys or for other reasons. The result, of course, is a false signal. Another disadvantage of an apparatus of this type is that, of necessity, it must be mounted in close relation to the vertical portion of cable between the hook block and the lifting carriage. If the lifting carriage is of the traversing type and if the interface device is of the electrical type, an electrical collector system must be employed to transmit the signal from the lifting carriage to the winch control system, the former being movable with respect to the latter. Electrical collector systems increase expense of fabrication and typically require significant maintenance to assure system integrity. Yet another disadvantage of an apparatus of this type is that an attempt to lift a load which is off-center with respect to the lifting carriage vertical centerline will often result in false signaling caused by the angle at which the cable is caused to pass through the bale.

OBJECTS OF THE INVENTION

It is a primary object of the present invention to provide an apparatus for sensing slack cable which overcomes the abovenoted disadvantages of the prior art.

Another object of the present invention is to provide a slack cable sensing apparatus for preventing cable unraveling and fouling on lifting winches.

Another object of the present invention is to provide such an apparatus which can be added to existing equipment.

Yet another object of the present invention is to provide a slack cable sensing apparatus employing spring biasing means to effect actuation of an interface device during slack cable conditions.

A further object of the present invention is to provide a slack cable sensing apparatus for use on material handling gantry cranes.

A still further object of the present invention is to provide a slack cable sensing apparatus incorporating spring biasing means to effect actuation of an electrical limit switch interface device during slack cable condition.

How these and further objects of the invention are accomplished will be described in the following specification, taken in conjunction with the drawings. Generally, however, they are accomplished by providing a slack cable sensing device mounted adjacent the winch and having a first taut cable position and a second slack cable position. In the latter, an interface device is actuated to preclude further cable unwinding. In the preferred embodiment, the slack cable sensing device has a mounting bracket and at least two lugs for supporting a roller subassembly. This subassembly, having a pivot roll, side beams and guide rolls, is pivotable between a first or second position when sensing taut or slack cable respectively. The guide rolls are mounted between the beams in parallel spaced-apart relationship providing a slot through which the cable is reeved. One side beam has a pedestal extending upward to provide mounting points for an adjustable screw and for one end of a biasing spring, the other end of which is secured to the mounting bracket. The slack cable sensing device of the present invention also includes a plunger-operated electrical limit switch which serves as an interface device, is mounted so as to be actuated by the adjustable screw, and provides for disabling the winch in the cable unwinding direction. When the cable is taut the subassembly is urged to its first position in opposition to the biasing spring. The limit switch contacts are open permitting cable unwinding by a hydraulic winch valve. When the cable becomes slack, the spring causes the subassembly to move to its second position, where the limit switch plunger causes the limit switch contacts to close. The winch valve is thereby disabled thru a solenoid operated shut off valve and further cable unwinding is precluded.

Other features of the present invention which aid in satisfying the above-noted objects will be described in the following detailed description of the preferred embodiment.

DESCRIPTION OF THE DRAWINGS

The illustrated embodiment may best be described by reference to the accompanying FIGURES where like reference numerals are used to identify like components.

Figure 1:
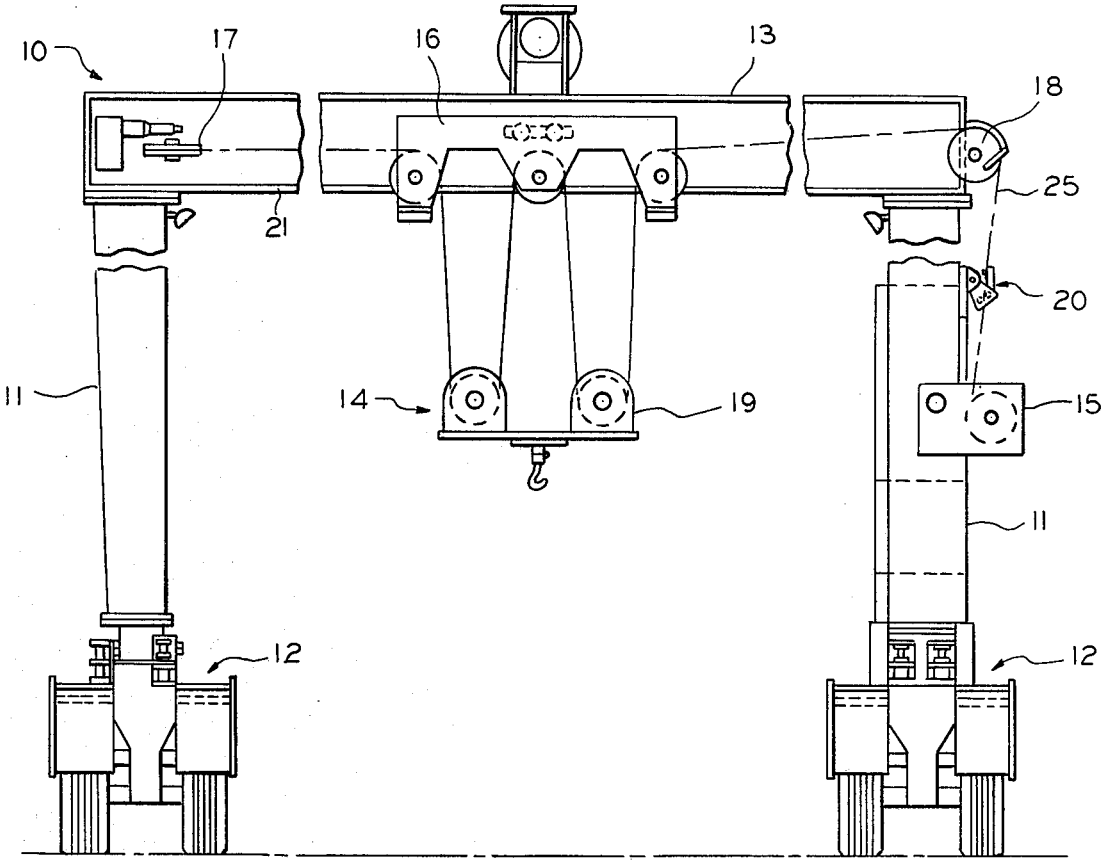
FIG. 1 is a front elevation view of a U-shaped material handling gantry crane of a type with which the slack cable sensing the present invention may be utilized.

ALL FIGURES are drawn for the ease of explanation of the basic teachings of the present invention. Extensions of the FIGURES with respect to number, position, relationship and dimensions will be within the skill of the art after the teachings of the present invention have been read and understood. Furthermore, when the terms "right," "left," "front," "back," "vertical," "horizontal" and similar terms are used herein, it should be understood that these terms have reference only to the structure shown in the drawings as it would appear to a person viewing the drawings and are utilized only to facilitate describing the invention.

DESCRIPTION OF THE PREFERRED EMBODIMENT

Before proceeding to a description of the illustrated embodiment, it should be understood that the slack cable sensing apparatus of the present invention is useful in any device where it is desired to sense and signal a slack cable condition. Such applications may include, but are not limited to, overhead traveling cranes, material handling machinery, process machinery or, as in the illustrated embodiment, mobile gantry cranes.

Referring now to FIG. 1, a gantry type mobile crane is shown to include a pair of U-shaped gantries 10 (only the forward one of which is visible in FIG. 1) connected by side girders (not shown). Each gantry includes a pair of vertical column members 11 resting at their lower ends on truck assemblies 12 and supporting horizontal cross members 13 at their upper ends.

Gantry 10 also includes a lifting assembly 14 comprising a winch 15, a trolley 16, idler sheaves 17 and 18, a hook block 19 and a pair of slack cable sensors 20, which will be described in detail later. As those skilled in the art will appreciate, the trolley 16 includes wheels (not shown) which ride on flanges 21 on the bottom of cross member 13. A cable 25 is coupled between the winch 15 and the trolley 16 through sensor 20 in a manner which will be described in greater detail hereafter. Because the operation of the trolley 16 and hook block 19 in and of themselves form no part of the invention, they will not be discussed in detail here. It will be sufficient for purposes of understanding the invention merely to state that the trolley may be moved laterally along the cross member 13 and the hook block 19 may be moved upward and downward for the purpose of positioning, lifting, and lowering a load. A detailed description of such operation can be found in Scannell's U.S. Pat. No. 3,805,967, issued Apr. 23, 1974, and entitled "Dual Hook Hoist Apparatus."

Figure 2:
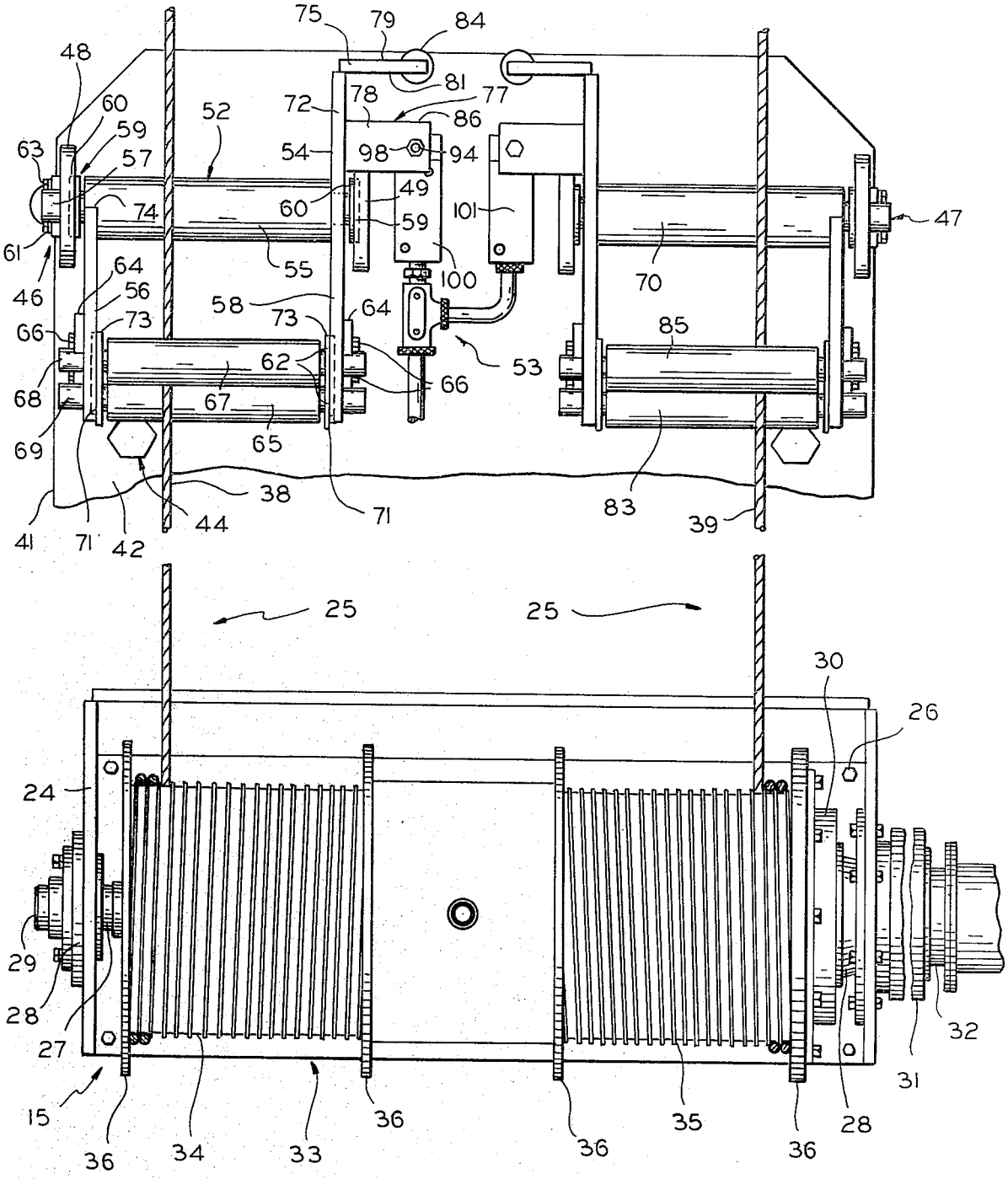
FIG. 2 is a front elevation view of the winch and sensing components of FIG. 1.
Figure 3:
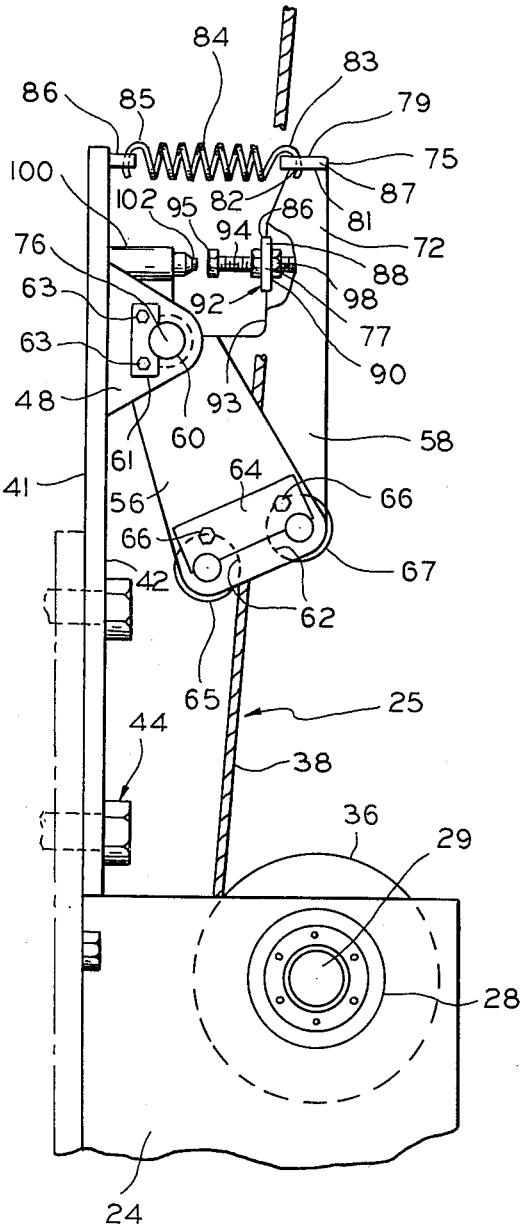
FIG. 3 is a side elevation view of the winch and sensor of FIG. 2, cable being shown in a taut condition, and with portions of the slack cable sensor being cut away.
Figure 4:
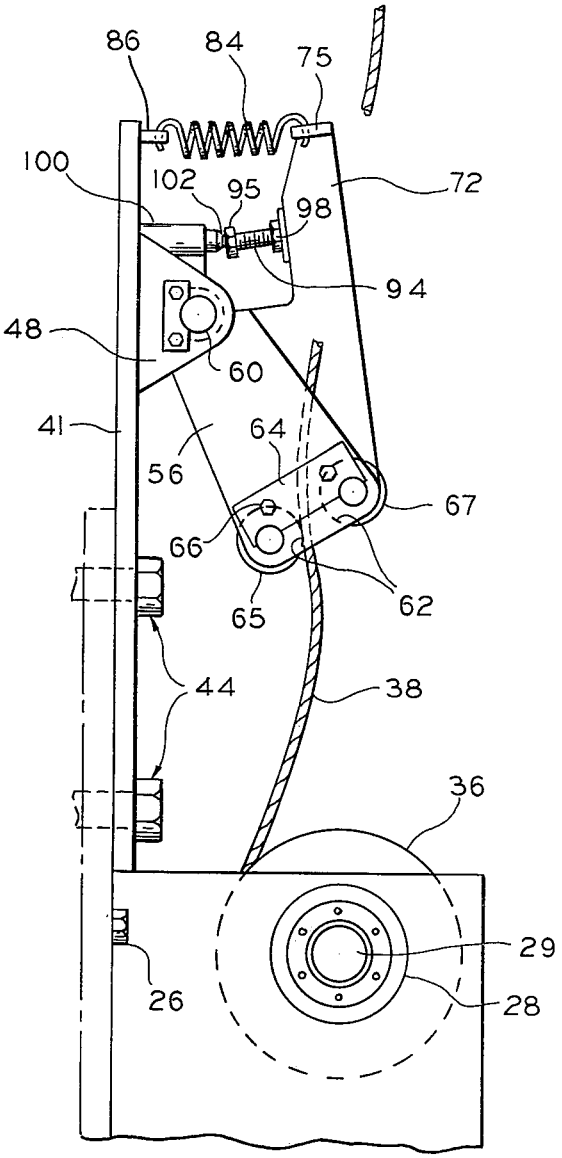
FIG. 4 is a view similar to that of FIG. 3, except the cable is shown in slack condition.

Referring now to FIGS. 2–4, winch 15 includes a mounting bracket 24, coupled to column 11 by bracket bolts 26. The winch also includes a spindle 27, spindle bearings 28, a bearing end cap 29, a brake 30, a gear-reducer 31 and a bi-rotational motor 32, in this case a hydraulic motor. Winch 15 also includes a substantially cylindrical drum 33 having two sets of annular cable retaining plates 36 and two oppositely-spiralled cable guiding grooves 34 and 35. Cable 25 has a first end segment 39 and second end segment 38. Segment 39 is attached near the right end of drum 33, wrapped around guiding groove 35 and extends upward therefrom while segment 38 is attached near the left end of drum 33, wrapped around guiding groove 34 and extends upward therefrom. One skilled in the art will appreciate that rotation of the winch drum 33 in a counterclockwise direction (as viewed in FIGS. 3–4) will cause load lifting while rotation of the drum 33 in a clockwise direction will cause a load to be lowered.

These FIGURES also show a pair of slack cable sensing devices 46 and 47 along with their associated electrical wiring components 53. While separate mounting brackets may be used for each, in the illustrated embodiment both devices are mounted on a common mounting bracket 41 secured to column 11 in a position above winch 15 by bolts 44. Since the left slack cable sensing device 46 is a mirror-image of device 47, the construction and operation of only the left device 46 will be described in detail and, while the description relates to the sensing of slack cable in segment 38 of cable 25, it will be appreciated that device 47 will operate similarly for sensing slack cable in segment 39. While it may not always be necessary to use two sensing devices, cranes such as the one illustrated in FIG. 1 may develop slack in one or both segments so that the use of two devices is preferred to avoid load tipping or spillage.

Sensor 46 includes a pair of support lugs 48 and 49 and a roller subassembly 52 pivotably mounted therebetween. Roller subassembly 52 includes a pivot roll 55 having spindle 57, said spindle 57 being pivotably supported at either end by spindle bearings 59 and being secured to support lug 48 by cap plate 61 and bolts 63.

Support lugs 48 and 49 are of substantially the same height, and the height must be sufficient to prevent pivot roll 55 from coming into contact with the mounting bracket face 42 and the inner guide roll 65 from contacting said face when the sensor is in the taut cable position of FIG. 3. The height must also be selected so that the head 95 of adjustable screw 94 can actuate the limit switch operating plunger 102 when the sensor is in the second slack cable position of FIG. 4. Roller subassembly 52 further includes a left roll beam 56, a right roll beam 58, inner guide roll 65, and outer guide roll 67. The horizontal spacing between the opposing faces of roll beams 56 and 58 should be selected so as to be slightly greater than the width of the grooved portion 34 of drum 33 so as to permit, during normal winch operation, the full excursion of the cable 25 across the winch drum face.

Inner guide roll 65 includes a shaft 69 which is rotatably mounted on shaft support bearings 71. In similar fashion, outer guide roll 67 includes a shaft 68 rotatably mounted on shaft support bearings 73. Bearings 59 are located and positioned within appropriately sized pockets 60 formed in the opposing faces of support lugs 48 and 49, while bearings 71 and 73 are located and positioned within appropriately sized pockets 62 formed in the opposing faces of roll beams 56 and 58. Roll shafts 68 and 69 are secured in position by cap plate 64 and bolts 66. Pockets 60 have holes at their center for receiving and securing the ends of spindle 57. Similarly, pockets 62 have holes at their center for receiving and securing the ends of roll shafts 68 and 69. The upper end 74 of roll beam 56 is rigidly secured to the left end of pivot roll 55 and the right end of roll 55 is rigidly secured to the inner surface 54 of right roll beam 58.

The diameters of guide rolls 65 and 67, while conveniently selected to be substantially equal, may not necessarily be so. In any event, the spacing between the opposing longitudinal surfaces of guide rolls 65 and 67 should be greater than the diameter of cable 25.

Right roll beam 58 also includes an extended pedestal arm 72. An elongate spring plate 75 is perpendicularly secured to the top of arm 72 and a screw bracket 77 is secured to arm 72 intermediate plate 75 and roller 55.

Rectangular-shaped spring plate 75 includes a vertical edge 87, upper and lower coplanar surfaces 79 and 81 respectively and is mounted so that its edge 87 is substantially parallel to the mounting bracket 41. Spring plate 75 has a hole 82 at its free end between surfaces 79 and 81, the hole having a diameter sufficient to accommodate the insertion of a hook-shaped end 83 of a spring 84. The other end 85 of spring 84 is coupled to an anchor lug 86 which is coplanar with plate 75 and is located on and affixed to the mounting bracket 41.

Screw bracket 77 is generally rectangular and has a top edge 86, an end 88 and front and rear vertical surfaces, 90 and 92, respectively. End 88 is rigidly mounted to the rear edge 93 of pedestal arm 72 so that the surfaces 90 and 92 are parallel to the mounting bracket face 42 when sensing device 46 is in a first position shown in FIG. 3. An adjustable actuating screw 94 is perpendicularly secured through surfaces 90 and 92 adjacent the end of plate 77 remote from arm 72 using locking nuts 98. The screw 94 has a head 95. Affixed to the outward face 42 of mounting bracket 41 is a sensor interface device which, in this example, is a plunger-operated electrical limit switch 100 with normally open contacts 103 (see FIG. 5). The limit switch 100 and screw 94 are so positioned that the adjusting screw head 95 bears upon the limit switch operating plunger 102 when the extended pedestal arm 72 is moved toward the mounting bracket 41 by spring 84. Such movement occurs when the cable becomes slack as shown by FIG. 4.

Referring now to FIGS. 1, 2 and 3, reeving of the crane is accomplished in the following manner. Cable 25 has a first end segment 39 and a second end segment 38. Segment 39 of cable 25 is threaded upwardly between spaced-apart guide rolls 65 and 67 of device 46, outward of pivot roll 55, over sheave 18 and sequentially to the other pulleys and sheaves of lifting assembly 14 in a fashion familiar to one skilled in the art. Segment 39 of cable 25 is then brought downwardly and outwardly of pivot roll 70 of second slack cable sensing apparatus 47, downwardly between spaced-apart guide rolls 83 and 85 of said second sensing apparatus 47, and is attached near the right end of drum 33 to cable guiding groove 35. Segment 38 of cable 25 is then attached near the left end of drum 33 to cable guiding groove 34. In this manner, cable 25 couples winch 15 and trolley 16 of lifting assembly 14 through sensor 20 to achieve slack cable sensing.

Figure 5:
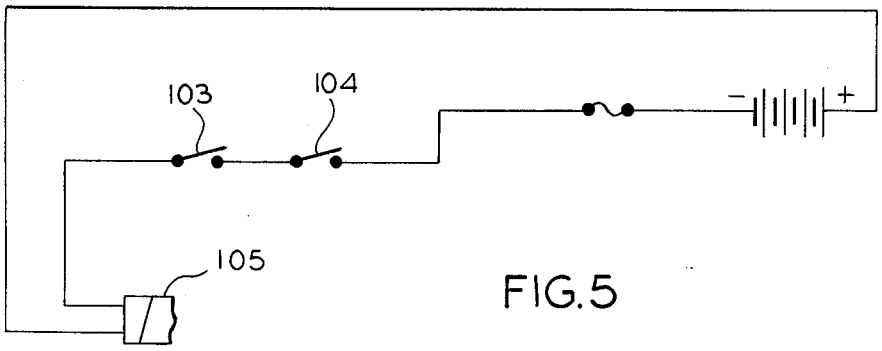
FIG. 5 is an electrical schematic diagram of a portion of the winch drum electro-hydraulic system showing the limit switch contact of the exemplary slack cable sensing apparatus interface device with cable in taut position and a source of electrical power and a solenoid of a winch hydraulic shut off valve.

Referring now to FIGS. 3, 4 and 5 and with the crane reeved as described above, it will be appreciated that rotation of the winch drum counterclockwise (FIG. 3) so as to wind cable 25 on grooved sections 34 and 35 will cause the cable to become taut and raise a load. Because cable segment 38 bears upon the inner guide roll 65 and against the biasing force of spring 84, subassembly 52 is pivoted about the centerline 76 of spindle 57 and moves the guide rolls 65 and 67 and roll beams 56 and 58 toward the mounting bracket 41. The screw 94 is moved away from plunger 102 of electrical limit switch 100, opening the contact 103. As along as the contact remains open the winch can be operated in either the winding or unwinding direction.

When the load comes to rest, and slack appears in the cable 25, the roller subassembly 52 no longer being biased by the force of taut cable 25, is caused to pivot toward the position shown in FIG. 4 by spring 84. The head 95 of adjustable screw 94 engages the operating plunger 102 of limit switch 100, closing the limit switch contacts 103 of FIG. 5 and engaging the circuit of solenoid 105 of winch hydraulic shut off valve (not shown) in the cable unwinding mode. Further operation of the drum 33 in the unwinding direction is thus precluded and the cable is prevented from becoming unraveled. The length of the adjustable screw 94 may be conveniently modified using locking nuts 98 to achieve lowering mode disabling within a range of cable slackness and to compensate for cable stretching. Similarly, sensing device 47 includes a limit switch 101, having a contact 104 (FIG. 5) coupled in series with contact 103 to disable the winch when both contacts are closed. For other types of cranes or material handling devices where a single strand of cable is wound onto a drum, only a single sensing device is required.

While only a single embodiment of the invention is illustrated and described, it is not intended to be limited thereby but only by the scope of the appended claims.

I claim:

1. In combination, a gantry type crane having frame means, load handling means mounted on said frame means for supporting a load and for moving the same vertically and transversely relative to said frame means, a pair of cables coupled to the load handling means, drum means mounted on said frame means, each of said cables being connected to said drum means whereby rotation of said drum means in a first direction will elevate said load and rotation thereof in an opposite direction will lower said load, each of said cables tending to become slack when the portion of the load supported thereby engages a support surface, drive means for driving said drum means, first and second disabling means mounted on said frame means and coupled to said drive means and effective when both are in an operative position to disable said drive means, biasing means coupled to said disabling means for urging said disabling means into their operative positions, said first and second cables respectively engaging said first and second disabling means and each being effective when taut to hold its associated disabling means out of its operative position, said biasing means being effective for individually moving said first and second disabling means into its operative position as its associated cable becomes slack whereby said drum means will be arrested when both cables are slack.

2. The combination set forth in claim 1 wherein said disabling means includes first and second arm means mounted for independent pivotal movement on said frame means and adjacent said first and second cables, respectively, said cables engaging said first and second arm means for selectively maintaining the same out of their operative positions and said biasing means independently urging said first and second arm means into their respective operative positions, said arm means being effective when both are in their operable positions for disabling said drive means.

3. The combination set forth in claim 2 and including first and second series connected switch means, circuit means operative to disable said drive means when both of said switch means are actuated, said first and second arm means being coupled to said first and second switch means, respectively, for independently actuating said switch means when in its operative position.

4. The combination set forth in claim 3 wherein each arm means includes a pair of elongate rollers mounted in spaced apart relation, the cable associated with each arm means passing between said rollers to maintain the coupling between said arm means and said cables.

5. The combination set forth in claims 2, 3 or 4 wherein said disabling means includes normally de-energized means in circuit with said first and second switch means, said first and second switch means being operative to complete an energizing circuit to said normally de-energized means whereby said drive means will be deactuated when both of said cables are slack.

* * * * *